US012631181B2

(12) United States Patent
Fukaya

(10) Patent No.: US 12,631,181 B2
(45) Date of Patent: May 19, 2026

(54) SCROLL COMPRESSOR

(71) Applicant: KABUSHIKI KAISHA TOYOTA JIDOSHOKKI, Aichi (JP)

(72) Inventor: Yoshihiro Fukaya, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 19/050,387

(22) Filed: Feb. 11, 2025

(65) Prior Publication Data

US 2025/0264101 A1 Aug. 21, 2025

(30) Foreign Application Priority Data

Feb. 16, 2024 (JP) ..... 2024-021660

(51) Int. Cl.

| | |
|---|---|
| ***F04C 28/06*** | (2006.01) |
| ***F04C 18/02*** | (2006.01) |
| ***F04C 28/04*** | (2006.01) |
| ***F04C 28/08*** | (2006.01) |
| ***F04C 28/22*** | (2006.01) |
| ***F04C 29/00*** | (2006.01) |
| *F04C 23/00* | (2006.01) |

(52) U.S. Cl.

CPC ..... *F04C 28/06* (2013.01); *F04C 18/0215* (2013.01); *F04C 28/04* (2013.01); *F04C 28/08* (2013.01); *F04C 28/22* (2013.01); *F04C 29/0057* (2013.01); *F04C 23/008* (2013.01)

(58) Field of Classification Search

CPC ..... F04C 26/06; F04C 26/04; F04C 26/08; F04C 26/22; F04C 18/0215; F04C 23/008; F04C 29/0057

USPC ..... 417/326

See application file for complete search history.

(56) References Cited

U.S. PATENT DOCUMENTS 5,433,589 A * 7/1995 Wada ..... F04C 15/0065 418/57
5,772,415 A * 6/1998 Monnier ..... F04C 29/0057 418/57
5,803,716 A * 9/1998 Wallis ..... F04C 18/0215 417/310

(Continued)

FOREIGN PATENT DOCUMENTS

JP H08-159052 A 6/1996

*Primary Examiner* — Charles G Freay

(74) *Attorney, Agent, or Firm* — Greenblum & Bernstein, P.L.C.

(57) ABSTRACT

A scroll compressor includes a housing, a rotary shaft, a motor, a controller, a compression mechanism including a fixed scroll and an orbiting scroll, an eccentric shaft, and a bushing. An orbital radius of the orbiting scroll changes with swinging of the bushing about the eccentric shaft. The controller performs a startup operation to discharge liquefied refrigerant from the compression mechanism before performing a normal operation. In the startup operation, the controller performs a startup reverse rotation in which the controller rotates the motor in reverse and swings the bushing, a startup forward rotation, after the startup reverse rotation, in which the controller rotates the motor forward while reducing an acceleration in a rotational speed of the motor, a startup liquid discharge in which the controller rotates the motor at the predetermined rotational speed.

4 Claims, 3 Drawing Sheets

(56) References Cited

U.S. PATENT DOCUMENTS

| | | | | |
|---|---|---|---|---|
| 6,648,604 | B1 * | 11/2003 | Lifson | F04C 28/28 417/325 |
| 8,292,599 | B2 * | 10/2012 | Lifson | F04C 23/008 417/325 |
| 10,385,852 | B2 * | 8/2019 | Zhang | F04C 28/06 |

* cited by examiner

SCROLL COMPRESSOR

CROSS-REFERENCE TO RELATED APPLICATION

This application claims priority to Japanese Patent Application No. 2024-021660 filed on Feb. 16, 2024, the entire disclosure of which is incorporated herein by reference.

The present disclosure relates to a scroll compressor.

BACKGROUND ART

A scroll compressor includes a housing, a rotary shaft, a motor, and a compression mechanism. The rotary shaft is rotatably supported by the housing. The motor rotates the rotary shaft. The compression mechanism is driven by the motor, and compresses refrigerant. The compression mechanism includes a fixed scroll and an orbiting scroll. The fixed scroll has a fixed scroll base plate having a disc shape, and a fixed scroll spiral wall. The fixed scroll spiral wall extends from the fixed scroll base plate. The orbiting scroll includes an orbiting scroll base plate having a disc shape, and an orbiting scroll spiral wall. The orbiting scroll base plate faces the fixed scroll base plate. The orbiting scroll spiral wall extends from the orbiting scroll base plate toward the fixed scroll base plate. The orbiting scroll spiral wall meshes with the fixed scroll spiral wall. The orbiting scroll and the fixed scroll cooperate to compress refrigerant with rotation of the rotary shaft.

For example, Japanese Patent Application Publication No. H08-159052 discloses a rotary shaft including an eccentric shaft. The eccentric shaft extends parallel to an axis of the rotary shaft at a position eccentric to an axis of the rotary shaft. A bushing is mounted on the eccentric shaft. The bushing is swingable about the eccentric shaft. Swinging of the bushing about the eccentric shaft varies an orbital radius of the orbiting scroll.

In this scroll compressor, refrigerant may be cooled and liquefied when the scroll compressor is stopped. When the scroll compressor starts in a state in which liquefied refrigerant exists, liquid compression occurs in the compression mechanism when liquefied refrigerant is being discharged from the compression mechanism. When liquid compression occurs in the compression mechanism, loads are applied to both the fixed scroll spiral wall and the orbiting scroll spiral wall, which may lead to issues such as deformation of the fixed scroll spiral wall and the orbiting scroll spiral wall. Therefore, there is a demand for efficiently discharging liquefied refrigerant from the compression mechanism while loads applied to the fixed scroll spiral wall and the orbiting scroll spiral wall are suppressed at the start of the scroll compressor.

SUMMARY

In accordance with an aspect of the present disclosure, there is provided a scroll compressor including a housing; a rotary shaft rotatably supported by the housing; a motor configured to rotate the rotary shaft; a controller configured to control driving of the motor; a compression mechanism driven by the motor and configured to compress refrigerant, the compression mechanism including: a fixed scroll that includes a fixed scroll base plate having a disk shape, and a fixed scroll spiral wall extending from the fixed scroll base plate; and an orbiting scroll that includes an orbiting scroll base plate having a disk shape and facing the fixed scroll base plate, and an orbiting scroll spiral wall extending from the orbiting scroll base plate and meshing with the fixed scroll spiral wall, the orbiting scroll and the fixed scroll cooperating to compress refrigerant with rotation of the rotary shaft; an eccentric shaft extending from the rotary shaft at a position eccentric to an axial line of the rotary shaft, the eccentric shaft extending parallel to the axial line of the rotary shaft; and a bushing mounted on the eccentric shaft and swingable about the eccentric shaft, the bushing swinging about the eccentric shaft to change an orbital radius of the orbiting scroll. The controller performs a startup operation to discharge liquefied refrigerant from the compression mechanism before performing a normal operation in which the motor is driven at a command rotational speed. In the startup operation, the controller performs a startup reverse rotation in which the motor rotates in reverse and the bushing swings to reduce the orbital radius of the orbiting scroll so that a gap between the fixed scroll spiral wall and the orbiting scroll spiral wall is increased, the controller performs a startup forward rotation, after the startup reverse rotation, in which the motor rotates forward while an acceleration in a rotational speed of the motor is reduced as compared to the acceleration in the rotational speed in the startup reverse rotation to maintain a posture of the bushing, and the controller performs a startup liquid discharge, when the rotational speed of the motor reaches a predetermined rotational speed by performing the startup forward rotation, in which the motor is driven at the predetermined rotational speed to cause the orbiting scroll to make orbital motion so that the liquefied refrigerant is discharged from the compression mechanism.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of a scroll compressor with reference to FIGS. 1 to 5. The scroll compressor of the present embodiment is used for a vehicle air conditioner.

Overview of Scroll Compressor

Figure 1:
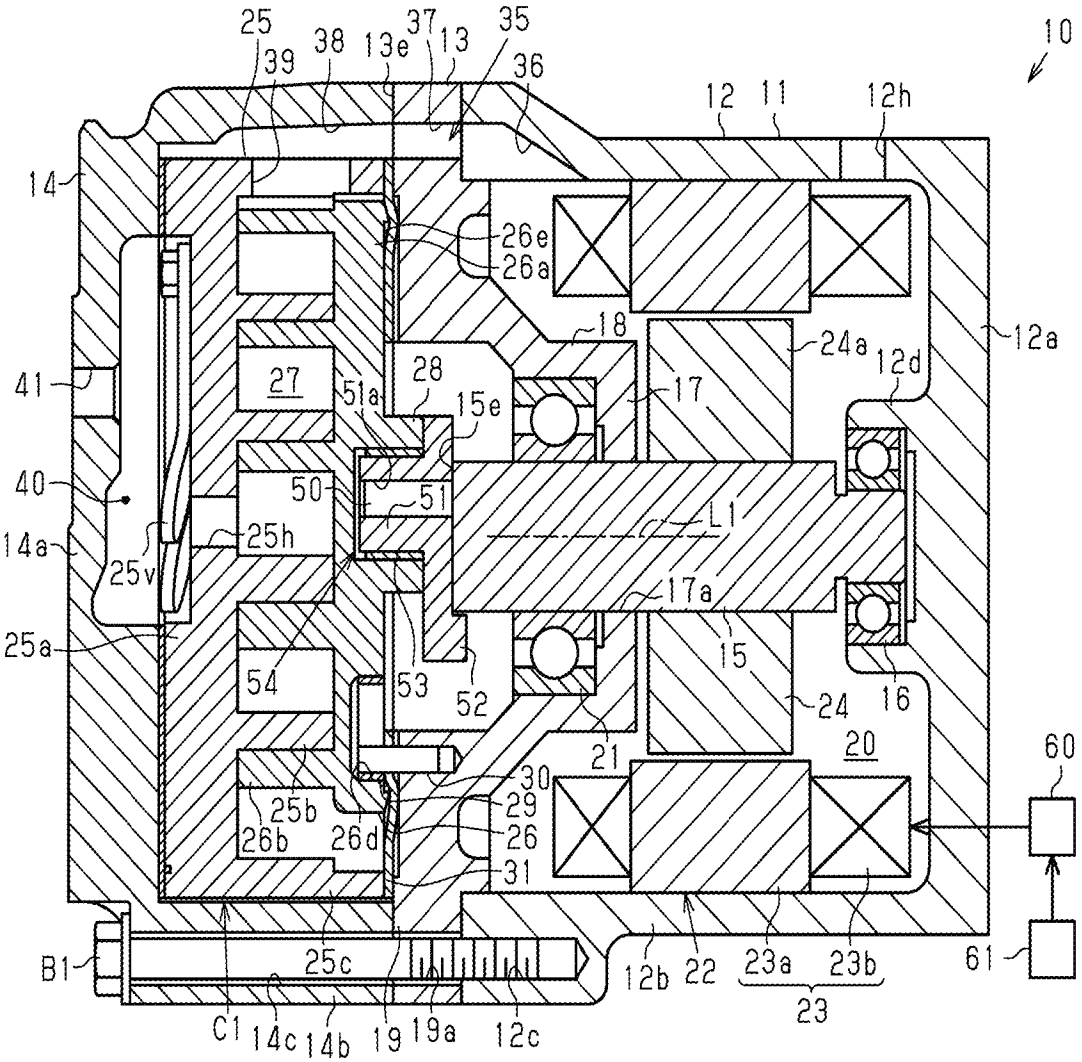
FIG. 1 is a cross-sectional view of a scroll compressor according to an embodiment.

As illustrated in FIG. 1, a scroll compressor 10 includes a housing 11 having a tubular shape. The housing 11 includes a motor housing 12, a shaft support housing 13, and a discharge housing 14. The motor housing 12, the shaft support housing 13, and the discharge housing 14 are made of a metal material. The motor housing 12, the shaft support housing 13, and the discharge housing 14 are made of, for example, aluminum. The scroll compressor 10 includes a rotary shaft 15. The rotary shaft 15 is accommodated in the housing 11.

The motor housing 12 includes an end wall 12*a* having a plate shape, and a peripheral wall 12*b* having a tubular shape. The peripheral wall 12*b* extends in a tubular shape from an outer peripheral portion of the end wall 12*a*. An axial direction of the peripheral wall 12*b* coincides with an axial direction of the rotary shaft 15. The motor housing 12 has a plurality of internally threaded holes 12*c*. The internally threaded holes 12*c* are formed at an opening end of the peripheral wall 12*b*. For the sake of description, only one of the internally threaded holes 12*c* is illustrated in FIG. 1. The motor housing 12 has an inlet port 12*h* through which refrigerant is drawn into the housing 11. The inlet port 12*h* is formed in the peripheral wall 12*b* on the end wall 12*a* side. The inlet port 12*h* provides communication between an inside and an outside of the motor housing 12.

The motor housing 12 has a bearing holder 12*d* having a cylindrical shape. The bearing holder 12*d* protrudes from a central portion of an inner surface of the end wall 12*a*. A first end of the rotary shaft 15 corresponding to one end of the rotary shaft 15 in the axial direction is inserted into the bearing holder 12*d*. The scroll compressor 10 includes a bearing 16. The bearing 16 is, for example, a rolling bearing. The bearing 16 is disposed between an inner peripheral surface of the bearing holder 12*d* and an outer peripheral surface of the first end of the rotary shaft 15. The first end of the rotary shaft 15 is supported by the motor housing 12 via the bearing 16.

The shaft support housing 13 has an end wall 17 having a plate shape and a peripheral wall 18 having a tubular shape. The peripheral wall 18 extends in a tubular shape from an outer peripheral portion of the end wall 17. An axial direction of the peripheral wall 18 coincides with the axial direction of the rotary shaft 15. The shaft support housing 13 has a flange wall 19 having an annular shape. The flange wall 19 extends outwardly in a radial direction of the rotary shaft 15 from an end of an outer peripheral surface of the peripheral wall 18 opposite from the end wall 17.

The shaft support housing 13 has an insertion hole 17*a* having a circular hole shape. The insertion hole 17*a* is formed at the center of the end wall 17. The insertion hole 17*a* extends through the end wall 17 in a thickness direction thereof. The rotary shaft 15 is inserted through the insertion hole 17*a*. A distal end surface 15*e* of the rotary shaft 15 on a second end side of the rotary shaft 15 corresponding to the other end thereof in the axial direction is positioned inside the peripheral wall 18.

The scroll compressor 10 includes a bearing 21. The bearing 21 is, for example, a rolling bearing. The bearing 21 is disposed between an inner peripheral surface of the peripheral wall 18 and the outer peripheral surface of the rotary shaft 15. The rotary shaft 15 is rotatably supported by the shaft support housing 13 via the bearing 21. Thus, the shaft support housing 13 rotatably supports the rotary shaft 15. Accordingly, the rotary shaft 15 is rotatably supported by the housing 11.

The shaft support housing 13 has a plurality of bolt insertion holes 19*a*. The bolt insertion holes 19*a* are formed in an outer peripheral portion of the flange wall 19. The bolt insertion holes 19*a* each extend through the flange wall 19 in a thickness direction thereof. The bolt insertion holes 19*a* of the flange wall 19 are in communication with their associated internally threaded holes 12*c* of the motor housing 12. For the sake of description, only one of the bolt insertion holes 19*a* is illustrated in FIG. 1.

The scroll compressor 10 includes a motor chamber 20. The motor chamber 20 is defined by the motor housing 12 and the shaft support housing 13. Thus, the motor housing 12 and the shaft support housing 13 cooperate to define the motor chamber 20. In this way, the motor chamber 20 is formed in the housing 11. The motor chamber 20 is in communication with the inlet port 12*h*. Refrigerant is drawn into the motor chamber 20 through the inlet port 12*h*.

The scroll compressor 10 includes a motor 22. The motor 22 is accommodated in the motor chamber 20. The motor 22 includes a stator 23 having a tubular shape, and a rotor 24 having a tubular shape. The rotor 24 is disposed inside the stator 23. The rotor 24 rotates together with the rotary shaft 15. The stator 23 surrounds the rotor 24. The rotor 24 includes a rotor core 24*a* fixed to the rotary shaft 15, and a plurality of permanent magnets (not illustrated) disposed in the rotor core 24*a*.

The stator 23 includes a stator core 23*a* having a tubular shape, and a motor coil 23*b*. The stator core 23*a* is fixed to the inner peripheral surface of the peripheral wall 12*b* of the motor housing 12. The motor coil 23*b* is wound around the stator core 23*a*.

The scroll compressor 10 includes a controller 60. The controller 60 controls driving of the motor 22. The controller 60 is an inverter device that controls a switching operation of switching elements. The controller 60 may be, for example, one or more processors (control circuits) that operate according to one or more dedicated hardware circuits and/or a computer program (software). The processors include the CPU as well as a memory such as RAM and ROM, and the memory stores program codes or instructions for causing the processors to perform various processing. The memory, that is, a computer-readable medium, includes any available media that can be accessed by general-purpose or dedicated computers.

The controller 60 is electrically connected to an air conditioning ECU 61. The air conditioning ECU 61 controls the entire vehicle air conditioner. The air conditioning ECU 61 is configured to obtain a cabin temperature, a set temperature, and the like. The air conditioning ECU 61 sends various commands such as an operation command for the motor 22 and a stop command for the motor 22 to the controller 60. The various commands from the air conditioning ECU 61 are commands that the controller 60 receives externally.

The controller 60 periodically turns the switching elements ON and OFF based on the commands from the air conditioning ECU 61. Specifically, the controller 60 performs pulse width modulation control (PWM control) for the switching elements based on the commands from the air conditioning ECU 61. More specifically, the controller 60 generates a control signal using a carrier signal (carrier wave signal) and a command voltage value signal (comparison target signal). Then, the controller 60 converts direct current power into alternating current power by using the generated control signals to perform ON/OFF control of the switching elements. The converted alternating current power is supplied to the motor coil 23*b* as driving power. This rotates the rotor 24, and the rotary shaft 15 rotates integrally with the rotor 24. Accordingly, the motor 22 rotates the rotary shaft 15.

Here, a state in which the motor 22 rotates forward, i.e., clockwise, corresponds to a state in which the rotor 24 rotates forward. On the other hand, a state in which the motor 22 rotates in reverse, i.e., counterclockwise, corresponds to a state in which the rotor 24 rotates in reverse. When the motor 22 rotates forward, the rotary shaft 15 rotates in a normal direction. At this time, a direction in which electric current flows from the controller 60 to the motor coil 23*b* while the motor 22 is rotating forward is defined as a first direction. Then, the motor 22 rotates in reverse when the direction of the electric current flowing from the controller 60 to the motor coil 23*b* is switched to a second direction, which is opposite to the first direction. Thus, the rotary shaft 15 rotates in a reverse direction opposite to the normal direction.

The controller 60 is capable of controlling a rotational speed of the motor 22 by estimating a position (rotation angle) of the rotor 24 based on the electric current flowing from the controller 60 to the motor coil 23*b*, without using a sensor such as a resolver that detects the position of the rotor 24. Accordingly, the controller 60 is configured to obtain the rotational speed of the motor 22 based on the electric current flowing from the controller 60 to the motor coil 23*b*.

The scroll compressor 10 includes a compression mechanism C1. The compression mechanism C1 includes a fixed scroll 25 and an orbiting scroll 26. The compression mechanism C1 is of the scroll type. The orbiting scroll 26 makes orbital motion relative to the fixed scroll 25 with the rotation of the rotary shaft 15. Then, the orbiting scroll 26 and the fixed scroll 25 cooperate to compress refrigerant with the rotation of the rotary shaft 15. Therefore, the compression mechanism C1 is driven by the motor 22 and compresses refrigerant.

The fixed scroll 25 has a fixed scroll base plate 25*a*, and a fixed scroll spiral wall 25*b*. The fixed scroll base plate 25*a* has a disk shape. A discharge port 25*h* is formed at the center of the fixed scroll base plate 25*a*. The discharge port 25*h* has a circular hole shape. The discharge port 25*h* extends through the fixed scroll base plate 25*a* in a thickness direction thereof. The fixed scroll spiral wall 25*b* extends from the fixed scroll base plate 25*a*. In addition, the fixed scroll 25 has an outer peripheral wall 25*c*. The outer peripheral wall 25*c* extends from an outer peripheral portion of the fixed scroll base plate 25*a*. The outer peripheral wall 25*c* surrounds the fixed scroll spiral wall 25*b*.

The scroll compressor 10 includes a valve mechanism 25*v*. The valve mechanism 25*v* is mounted on a surface of the fixed scroll base plate 25*a* opposite to the fixed scroll spiral wall 25*b*. The valve mechanism 25*v* is configured to open or close the discharge port 25*h*.

The orbiting scroll 26 includes an orbiting scroll base plate 26*a* and an orbiting scroll spiral wall 26*b*. The orbiting scroll base plate 26*a* has a disk shape. The orbiting scroll base plate 26*a* faces the fixed scroll base plate 25*a*. The orbiting scroll spiral wall 26*b* extends from the orbiting scroll base plate 26*a* toward the fixed scroll base plate 25*a* and meshes with the fixed scroll spiral wall 25*b*. The orbiting scroll 26 is disposed inside the outer peripheral wall 25*c*. The orbiting scroll 26 makes orbital motion inside the outer peripheral wall 25*c*. A distal end surface of the fixed scroll spiral wall 25*b* is in contact with the orbiting scroll base plate 26*a*. A distal end surface of the orbiting scroll spiral wall 26*b* is in contact with the fixed scroll base plate 25*a*.

The scroll compressor 10 has a compression chamber 27. The compression chamber 27 is defined by the fixed scroll base plate 25*a*, the fixed scroll spiral wall 25*b*, the orbiting scroll base plate 26*a*, and the orbiting scroll spiral wall 26*b*. Thus, the compression chamber 27 is defined between the fixed scroll 25 and the orbiting scroll 26. Refrigerant from an outside is drawn into and compressed in the compression chamber 27.

The scroll compressor 10 includes a boss 28. The boss 28 protrudes in a tubular shape from a central portion of an end surface 26*e* of the orbiting scroll base plate 26*a* opposite to the fixed scroll base plate 25*a*. The boss 28 has a cylindrical shape. An axial direction of the boss 28 coincides with the axial direction of the rotary shaft 15.

The orbiting scroll base plate 26*a* has a plurality of grooves 26*d*. The grooves 26*d* are formed around the boss 28 in the end surface 26*e* of the orbiting scroll base plate 26*a*. The grooves 26*d* are disposed at predetermined intervals in a circumferential direction of the rotary shaft 15. For the sake of description, only one of the grooves 26*d* is illustrated in FIG. 1. A ring member 29 having a ring shape is fitted into each of the grooves 26*d*. A pin 30 is inserted into the ring member 29. The pin 30 protrudes from an end surface 13*e* of the shaft support housing 13 on the orbiting scroll 26 side.

The scroll compressor 10 includes an elastic plate 31. The elastic plate 31 has an annular shape. The elastic plate 31 is held between the end surface 13*e* of the shaft support housing 13 and an opening end surface of the outer peripheral wall 25*c*. The elastic plate 31 constantly urges the orbiting scroll 26 toward the fixed scroll 25.

The discharge housing 14 includes an end wall 14*a* having a plate shape, and a peripheral wall 14*b* having a tubular shape. The peripheral wall 14*b* extends in a tubular shape from an outer peripheral portion of the end wall 14*a*. An axial direction of the peripheral wall 14*b* coincides with the axial direction of the rotary shaft 15. The peripheral wall 14*b* surrounds the fixed scroll 25. Thus, the fixed scroll 25 is accommodated in the housing 11.

The discharge housing 14 has a plurality of bolt insertion holes 14*c*. The bolt insertion holes 14*c* are formed in the peripheral wall 14*b*. For the sake of description, only one of the bolt insertion holes 14*c* is illustrated in FIG. 1. The bolt insertion holes 14*c* are in communication with their associated bolt insertion holes 19*a* of the flange wall 19.

Bolts B1 inserted through the bolt insertion holes 14*c* and the bolt insertion holes 19*a* of the flange wall 19 are screwed into the internally threaded holes 12*c* of the motor housing 12, respectively. As a result, the shaft support housing 13 is connected to the peripheral wall 12*b* of the motor housing 12, and the discharge housing 14 is connected to the flange wall 19 of the shaft support housing 13. Thus, the motor housing 12, the shaft support housing 13, and the discharge housing 14 are arranged in this order in the axial direction of the rotary shaft 15. The fixed scroll 25 is held between the end wall 14*a* of the discharge housing 14 and the shaft support housing 13. In this way, the fixed scroll 25 is fixed to the housing 11.

The scroll compressor 10 includes an inlet passage 35. The inlet passage 35 has a first groove 36, a first hole 37, a second groove 38, and a second hole 39. The first groove 36 is formed in a part of the inner peripheral surface of the peripheral wall 12*b* of the motor housing 12. The first groove 36 is opened at the opening end of the peripheral wall 12*b*. The first hole 37 is formed in the outer peripheral portion of the flange wall 19 of the shaft support housing 13. The first hole 37 extends through the flange wall 19 in the thickness direction thereof. The first hole 37 is in communication with the first groove 36. The second groove 38 is formed in a part of an inner peripheral surface of the peripheral wall 14*b* of the discharge housing 14. The second groove 38 is in communication with the first hole 37. The second hole 39 is formed in the outer peripheral wall 25*c* of the fixed scroll 25. The second hole 39 extends through the outer peripheral wall 25*c* in a thickness direction thereof. The second hole 39 is in communication with the second groove 38. The second hole 39 is in communication with an outermost peripheral portion of the compression chamber 27.

Refrigerant in the motor chamber 20 passes through the first groove 36, the first hole 37, the second groove 38, and the second hole 39, and is drawn into the compression chamber 27. Refrigerant drawn into the compression chamber 27 is compressed in the compression chamber 27 with the orbital motion of the orbiting scroll 26. In this way, the compression mechanism C1 compresses refrigerant drawn into the housing 11.

The scroll compressor 10 has a discharge chamber 40. The discharge chamber 40 is defined between the fixed scroll base plate 25*a* and the end wall 14*a* of the discharge housing 14. The discharge chamber 40 is connected to the discharge port 25*h*. Refrigerant compressed in the compression chamber 27 is discharged to the discharge chamber 40. The discharge housing 14 has an outlet port 41. The outlet port 41 is formed in the end wall 14*a* of the discharge housing 14. Refrigerant discharged to the discharge chamber 40 is discharged through the outlet port 41 to an outside of the housing 11.

The scroll compressor 10 includes an eccentric shaft 50. The eccentric shaft 50 protrudes from the distal end surface 15*e* of the rotary shaft 15, and extends parallel to an axial line L1 of the rotary shaft 15 at a position eccentric to the axial line L1 of the rotary shaft 15. Thus, the rotary shaft 15 includes the eccentric shaft 50. The eccentric shaft 50 is formed integrally with the rotary shaft 15. An axial direction of the eccentric shaft 50 extends in the same direction as the axial direction of the rotary shaft 15. The eccentric shaft 50 protrudes from the distal end surface 15*e* of the rotary shaft 15 toward the orbiting scroll 26.

The scroll compressor 10 includes a bushing 51. The bushing 51 has a cylindrical shape. A through hole 51*a* is formed inside the bushing 51. Thus, the bushing 51 has the through hole 51*a*. The eccentric shaft 50 is inserted into the through hole 51*a*. Thus, the bushing 51 is inserted into the eccentric shaft 50. The bushing 51 is disposed inside the boss 28. Thus, the bushing 51 is disposed in the boss 28.

Figure 2:
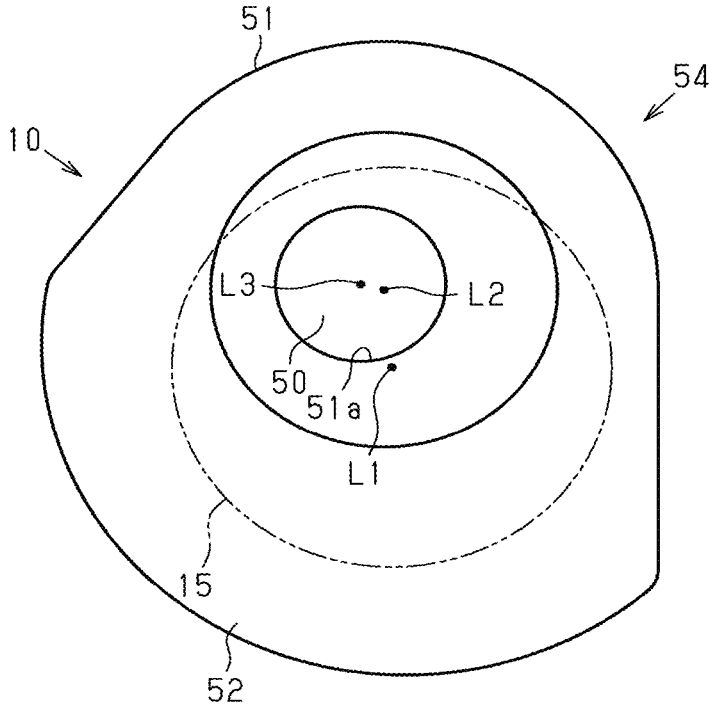
FIG. 2 is a front view illustrating a bushing and an eccentric shaft.

As illustrated in FIG. 2, the through hole 51*a* is formed in the bushing 51 with a center L3 of the through hole 51*a* positioned eccentric to a center L2 of the bushing 51. Thus, a thickness of the bushing 51 at a portion closer to the center L3 of the through hole 51*a* than the center L2 of the bushing 51 is thinner than that at a portion closer to the center L2 of the bushing 51 than the center L3 of the through hole 51*a*. The center L3 of the through hole 51*a* also corresponds to the center of the eccentric shaft 50. The bushing 51 is swingable about the eccentric shaft 50.

As illustrated in FIG. 1, the scroll compressor 10 includes a balance weight 52. The balance weight 52 is integrated into the bushing 51. The balance weight 52 is formed integrally with the bushing 51. The balance weight 52 protrudes outwardly from a portion of an outer peripheral surface of the bushing 51. The balance weight 52 is accommodated in the peripheral wall 18 of the shaft support housing 13.

The scroll compressor 10 includes a bearing 53. The bearing 53 is a sliding bearing having a cylindrical shape. The bearing 53 is disposed inside the boss 28. The bearing 53 is disposed between an inner peripheral surface of the boss 28 and the outer peripheral surface of the bushing 51. The bushing 51 is rotatably supported by the boss 28 via the bearing 53.

The rotation of the rotary shaft 15 is transmitted to the orbiting scroll 26 through the eccentric shaft 50, the bushing 51, and the bearing 53. This causes the orbiting scroll 26 to rotate. The pins 30 in contact with their associated inner peripheral surfaces of the ring members 29 prevent the orbiting scroll 26 from rotating, but only allows the orbiting scroll 26 to make orbital motion. Thus, the orbiting scroll 26 makes orbital motion while the orbiting scroll spiral wall 26*b* is in contact with the fixed scroll spiral wall 25*b*. The volume of the compression chamber 27 reduces with orbital motion of the orbiting scroll 26, thereby compressing refrigerant in the compression chamber 27. The orbiting scroll 26 makes orbital motion inside the outer peripheral wall 25*c* with the rotation of the rotary shaft 15. The balance weight 52 counterbalances a centrifugal force that acts on the orbiting scroll 26 when the orbiting scroll 26 makes orbital motion. This reduces the unbalance mass of the orbiting scroll 26.

Driven Crank Mechanism

The center L2 of the bushing 51 is positioned outward relative to the axial line L1 of the rotary shaft 15 in the radial direction of the rotary shaft 15. The center of the orbiting scroll base plate 26*a* coincides with the center L2 of the bushing 51. Then, a distance between the center L2 of the bushing 51 and the axial line L1 of the rotary shaft 15 corresponds to an orbital radius of the orbiting scroll 26. Since swinging of the bushing 51 about the eccentric shaft 50 changes the distance between the center L2 of the bushing 51 and the axial line L1 of the rotary shaft 15, the orbital radius of the orbiting scroll 26 changes. Therefore, in the scroll compressor 10, the orbital radius of the orbiting scroll 26 is changed with the swinging of the bushing 51 about the eccentric shaft 50. Accordingly, the eccentric shaft 50, the bushing 51, and the bearing 53 form a so-called driven crank mechanism 54 that changes the orbital radius of the orbiting scroll 26. The driven crank mechanism 54 of this type has been known.

In view of a slight processing error and an assembling error occurring in the fixed scroll 25 and the orbiting scroll 26, a gap (space) is provided between the fixed scroll spiral wall 25*b* and the orbiting scroll spiral wall 26*b*.

When the rotary shaft 15 rotates in the normal direction with the forward rotation of the motor 22, the bushing 51 swings about the eccentric shaft 50 according to a compressive load acting on the orbiting scroll 26. Swinging of the bushing 51 about the eccentric shaft 50 increases the distance between the center L2 of the bushing 51 and the axial line L1 of the rotary shaft 15, which increases the orbital radius of the orbiting scroll 26.

Figure 3:
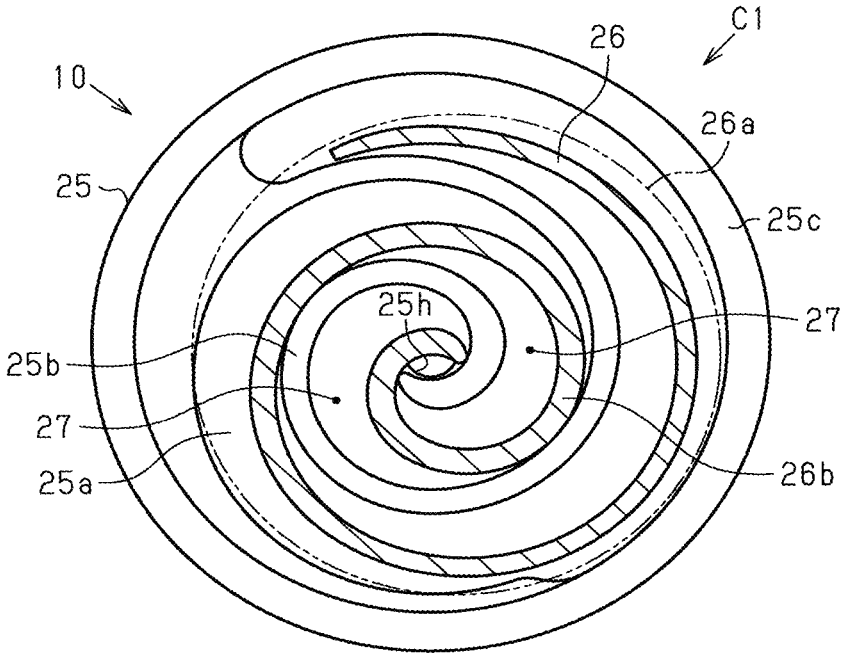
FIG. 3 is a cross-sectional view illustrating a fixed scroll and an orbiting scroll.

As illustrated in FIG. 3, when the orbital radius of the orbiting scroll 26 increases, the swinging of the bushing 51 about the eccentric shaft 50 is restricted at a time point at which the orbiting scroll spiral wall 26*b* is placed in contact with the fixed scroll spiral wall 25*b*. As a result, the orbital radius of the orbiting scroll 26 is fixed.

Furthermore, the rotation of the rotary shaft 15 is transmitted to the orbiting scroll 26 through the eccentric shaft 50, the bushing 51, and the bearing 53, so that the orbiting scroll 26 rotates in the normal direction. At the time point at which the orbiting scroll spiral wall 26*b* comes into contact with the fixed scroll spiral wall 25*b*, the pins 30 and the ring members 29 come into contact. This prevents the orbiting scroll 26 from rotating, but only allows the orbiting scroll 26 to make orbital motion in the normal direction. The orbiting scroll 26 makes orbital motion in the normal direction while the orbiting scroll spiral wall 26*b* is in contact with the fixed scroll spiral wall 25*b*. As a result, the volume of the compression chamber 27 is reduced while leakage of refrigerant from the compression chamber 27 is suppressed, so that refrigerant is compressed.

In assembling the orbiting scroll 26 to the fixed scroll 25, the bushing 51 is swung about the eccentric shaft 50 in a direction opposite to a direction in which the bushing 51 swings when the rotary shaft 15 rotates in the normal direction. Thus, the distance between the center L2 of the bushing 51 and the axial line L1 of the rotary shaft 15 reduces, which reduces the orbital radius of the orbiting scroll 26.

Figure 4:
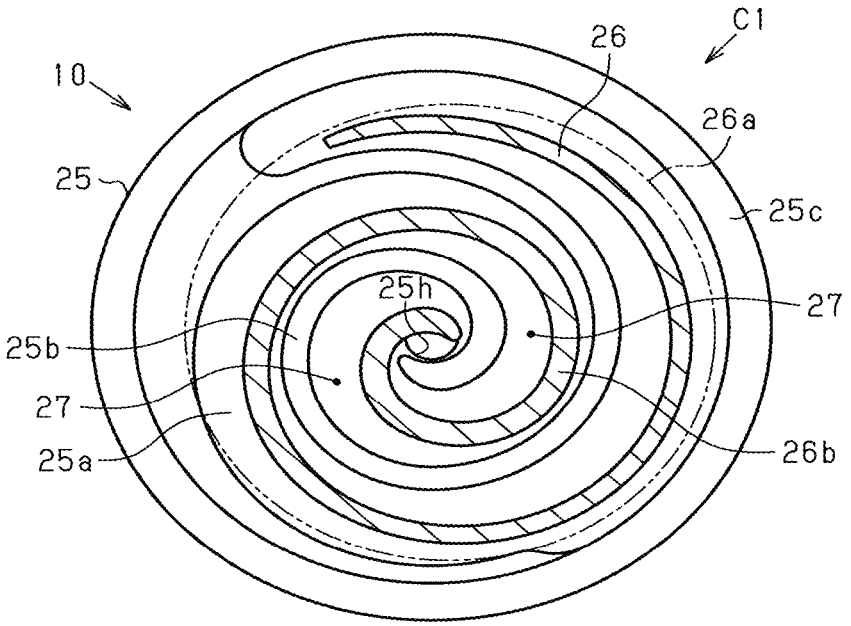
FIG. 4 is a cross-sectional view illustrating the fixed scroll and the orbiting scroll.

As illustrated in FIG. 4, when the orbital radius of the orbiting scroll 26 reduces, the orbiting scroll spiral wall 26*b* is positioned relative to the fixed scroll spiral wall 25*b* at a position where the orbiting scroll spiral wall 26*b* is not in contact with the fixed scroll spiral wall 25*b*. Therefore, the orbiting scroll 26 may be easily assembled to the fixed scroll 25. FIG. 4 illustrates a state in which the gap between the fixed scroll spiral wall 25*b* and the orbiting scroll spiral wall 26*b* is maximum.

When the bushing 51 swings about the eccentric shaft 50 in an opposite direction to the direction in which the bushing 51 swings when the rotary shaft 15 rotates in the normal direction, swinging of the bushing 51 is restricted until the distance between the center L2 of the bushing 51 and the axial line L1 of the rotary shaft 15 increases. When the bushing 51 swings about the eccentric shaft 50 in the opposite direction to the direction in which the bushing 51 swings when the rotary shaft 15 rotates in the normal direction, swinging of the bushing 51 is restricted when the distance between the center L2 of the bushing 51 and the axial line L1 of the rotary shaft 15 becomes minimum.

Normal Operation

Figure 5:
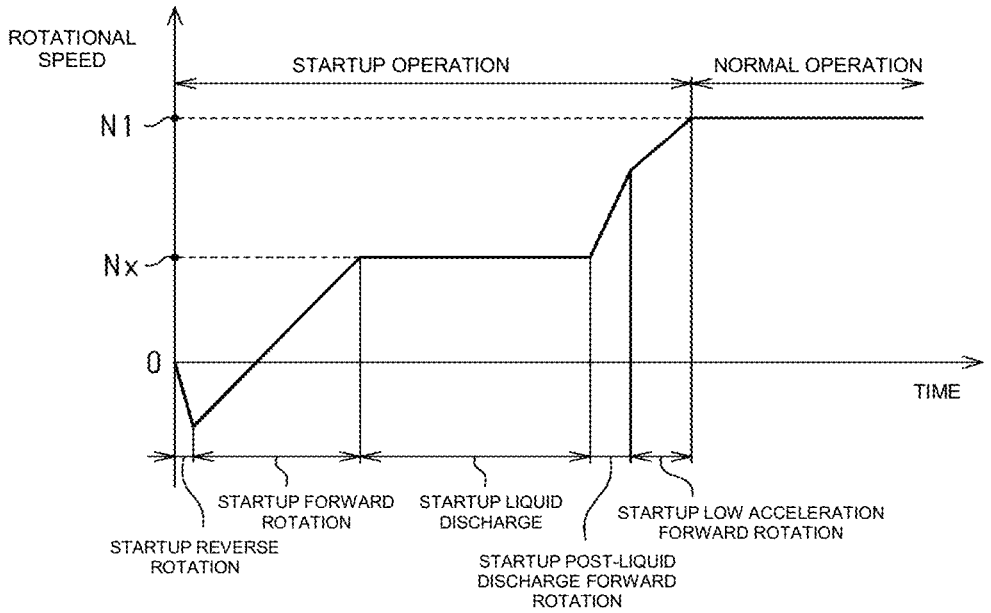
FIG. 5 is a chart indicating a change in a rotational speed of a motor.

FIG. 5 shows a change in the rotational speed of the motor 22. A program for performing a normal operation to drive the motor 22 as shown in FIG. 5 is pre-stored in the controller 60. Thus, the controller 60 performs the normal operation in which the motor 22 is driven at a command rotational speed for compressing refrigerant. In the normal operation, the controller 60 drives the motor 22 by sensorless control. The controller 60 estimates the position of the rotor 24 based on the electric current and input voltage to the motor 22 in the sensorless control.

Then, the controller 60 converts the electric current flowing to the motor 22 based on the estimated position of the rotor 24 into an excitation component current, i.e., a d-axis current, and a torque component current, i.e., a q-axis current. The controller 60 performs on-off control of the switching elements so that the d-axis current and the q-axis current become target values. Accordingly, in the normal operation, the motor 22 rotates at a command rotational speed N1 sent from the air conditioning ECU 61.

Startup Operation

A program for performing a startup operation to discharge liquefied refrigerant from the compression mechanism C1 before the normal operation is performed is pre-stored in the controller 60. Thus, the controller 60 performs the startup operation to discharge liquefied refrigerant from the compression mechanism C1 before performing the normal operation. The controller 60 performs the startup operation upon receiving a startup command from the air conditioning ECU 61. In addition, a program for switching an operation from the startup operation to the normal operation when the rotational speed of the motor 22 reaches the command rotational speed N1 is pre-stored in the controller 60.

A program for performing a startup reverse rotation, in the startup operation, in which the motor 22 rotates in reverse is pre-stored in the controller 60. Therefore, the controller 60 performs the startup reverse rotation in which the motor 22 rotates in reverse in the startup operation. In the startup reverse rotation, the controller 60 causes the bushing 51 to swing to reduce the orbital radius of the orbiting scroll 26 so that the gap between the fixed scroll spiral wall 25*b* and the orbiting scroll spiral wall 26*b* is increased.

Specifically, in the startup reverse rotation, the controller 60 causes the bushing 51 to swing so as to maximize the gap between the fixed scroll spiral wall 25*b* and the orbiting scroll spiral wall 26*b*, as illustrated in FIG. 4. In the startup reverse rotation, the controller 60 increases acceleration in the rotational speed of the motor 22 while rotating the motor 22 in reverse in order to cause the bushing 51 to swing so that the gap between the fixed scroll spiral wall 25*b* and the orbiting scroll spiral wall 26*b* is maximized. The "acceleration in the rotational speed of the motor 22" indicates the change in the rotational speed of the motor 22 per unit of time. When the startup reverse rotation is performed, the bushing 51 swings about the eccentric shaft 50 so that the distance between the center L2 of the bushing 51 and the axial line L1 of the rotary shaft 15 is reduced. The program for performing the startup reverse rotation first as the startup operation upon receiving the startup command from the air conditioning ECU 61 is pre-stored in the controller 60.

Referring to FIG. 5, in the startup operation, a program for performing a startup forward rotation in which the motor 22 rotates forward to maintain the posture of the bushing 51, after the startup reverse rotation is performed, is pre-stored in the controller 60. Thus, the controller 60 performs, after the startup reverse rotation, the startup forward rotation in which the motor 22 rotates forward to maintain the posture of the bushing 51. An inclination of the solid line indicating the change in the rotational speed of the motor 22 during the startup forward rotation is more gradual than an inclination of the solid line indicating a change in the rotational speed of the motor 22 during the startup reverse rotation. Therefore, the change in the rotational speed of the motor 22 per unit time during the startup forward rotation is smaller than the change in the rotational speed of the motor 22 per unit time during the startup reverse rotation. In this way, in the startup forward rotation, the controller 60 reduces the acceleration in the rotational speed of the motor 22 as compared to the acceleration in the rotational speed of the motor 22 in the startup reverse rotation.

In the startup operation, a program for performing a startup liquid discharge when the rotational speed of the motor 22 reaches a predetermined rotational speed Nx by performing the startup forward rotation is pre-stored in the controller 60. Thus, the controller 60 performs the startup liquid discharge when the rotational speed of the motor 22 reaches the predetermined rotational speed Nx by performing the startup forward rotation. During the startup liquid discharge, the controller 60 causes the orbiting scroll 26 to make orbital motion by driving the motor 22 at the predetermined rotational speed Nx so that liquefied refrigerant is discharged from the compression mechanism C1.

In the startup operation, a program for performing a startup post-liquid discharge forward rotation after the motor 22 is driven to rotate at the predetermined rotational speed Nx is pre-stored in the controller 60. Thus, in the startup operation, the controller 60 performs the startup post-liquid discharge forward rotation after the motor 22 is rotated at the predetermined rotational speed Nx. In the startup post-liquid discharge forward rotation, the controller 60 causes the bushing 51 to swing so that the fixed scroll spiral wall 25*b* and the orbiting scroll spiral wall 26*b* are placed in contact with each other, as illustrated in FIG. 3.

As shown in FIG. 5, an inclination of the solid line indicating a change in the rotational speed of the motor 22 during the startup post-liquid discharge forward rotation is substantially the same as the inclination of the solid line indicating the change in the rotational speed of the motor 22 during the startup reverse rotation. Therefore, the change in the rotational speed of the motor 22 per unit time during the startup post-liquid discharge forward rotation is substantially the same as the change in the rotational speed of the motor 22 per unit time during the startup reverse rotation. In the startup post-liquid discharge forward rotation, the controller 60 increases the acceleration in the rotational speed of the motor 22 and rotates the motor 22 forward in order to swing the bushing 51 so that fixed scroll spiral wall 25*b* and the orbiting scroll spiral wall 26*b* are placed in contact with each other, after the motor 22 rotates at the predetermined rotational speed Nx.

A direction in which the bushing 51 swings during the startup post-liquid discharge forward rotation is opposite to the direction in which the bushing 51 swings during the startup reverse rotation. Specifically, during the startup post-liquid discharge forward rotation, the bushing 51 swings about the eccentric shaft 50 so that the distance between the center L2 of the bushing 51 and the axial line L1 of the rotary shaft 15 increases.

A program for performing a startup low acceleration forward rotation, in which the rotational speed of the motor 22 gradually approaches the command rotational speed N1 in the normal operation after performing the startup post-liquid discharge forward rotation, is pre-stored in the controller 60, in the startup operation. Therefore, in the startup operation, the controller 60 causes the rotational speed of the motor 22 to gradually approach the command rotational speed N1 in the normal operation after performing the startup post-liquid discharge forward rotation. An inclination of the solid line indicating the change in the rotational speed of the motor 22 during the startup low acceleration forward rotation is more gradual than the inclination of the solid line indicating the change in the rotational speed of the motor 22 during the startup post-liquid discharge forward rotation. Thus, the change in the rotational speed of the motor 22 per unit time during the startup low acceleration forward rotation is smaller than the change in the rotational speed of the motor 22 per unit time during the startup post-liquid discharge forward rotation. In this way, in the startup low acceleration forward rotation, the controller 60 reduces the acceleration in the rotational speed of the motor 22 as compared to the startup post-liquid discharge forward rotation and rotates the motor 22 forward, after performing the startup post-liquid discharge forward rotation.

Operation of Embodiment

The following will describe the operation of the present embodiment.

In the scroll compressor 10, refrigerant may be cooled and liquefied when the scroll compressor 10 is stopped. Therefore, the controller 60 performs the startup operation to discharge liquefied refrigerant from the compression mechanism C1 before performing the normal operation to drive the motor 22 by the sensorless control. In the startup operation, the controller 60, firstly, performs the startup reverse rotation. When the startup reverse rotation is performed, the motor 22 rotates in reverse, which causes the bushing 51 to swing to reduce the orbital radius of the orbiting scroll 26 so that the gap between the fixed scroll spiral wall 25*b* and the orbiting scroll spiral wall 26*b* is increased. In this way, the gap between the fixed scroll spiral wall 25*b* and the orbiting scroll spiral wall 26*b* is increased before the normal operation is performed.

Next, the controller 60 performs the startup forward rotation after the startup reverse rotation. In the startup forward rotation, the acceleration in the rotational speed of the motor 22 is reduced as compared to the startup reverse rotation, so that the posture of the bushing 51 is maintained even if the rotation of the motor 22 forward is accelerated. Therefore, even if the forward rotation of the motor 22 is accelerated, the gap between the fixed scroll spiral wall 25*b* and the orbiting scroll spiral wall 26*b* is kept large.

Then, when the rotational speed of the motor 22 reaches the predetermined rotational speed Nx by performing the startup forward rotation, the controller 60 performs the startup liquid discharge in which the orbiting scroll 26 makes orbital motion by driving the motor 22 at the predetermined rotational speed Nx to discharge liquefied refrigerant from the compression mechanism C1. According to this, since the orbiting scroll 26 makes orbital motion with the gap between the fixed scroll spiral wall 25*b* and the orbiting scroll spiral wall 26*b* kept large, liquid compression hardly occurs in the compression mechanism C1.

Next, the controller 60 performs the startup post-liquid discharge forward rotation after the motor 22 is driven to rotate at the predetermined rotational speed Nx. As a result, the fixed scroll spiral wall 25*b* and the orbiting scroll spiral wall 26*b* are placed in contact with each other. Furthermore, the controller 60 performs the startup low acceleration forward rotation after the startup post-liquid discharge forward rotation. As a result, the rotation speed of the motor 22 gradually approaches the command rotational speed N1 in the normal operation. Then, the controller 60 switches the operation from the startup operation to the normal operation when the rotation speed of the motor 22 reaches the command rotational speed N1. Thus, the scroll compressor 10 compresses refrigerant with the compression mechanism C1 in the normal operation.

Effects of Embodiment

The above-described embodiment offers the following effects.

(1) The controller 60 performs the startup operation to discharge liquefied refrigerant from the compression mechanism C1 before performing the normal operation to drive the motor 22. In the startup operation, the controller 60, firstly, performs the startup reverse rotation. When the startup reverse rotation is performed, the motor 22 rotates in reverse, which causes the bushing 51 to swing to reduce the orbital radius of the orbiting scroll 26, so that the gap between the fixed scroll spiral wall 25*b* and the orbiting scroll spiral wall 26*b* is increased. In this way, the gap between the fixed scroll spiral wall 25*b* and the orbiting scroll spiral wall 26*b* is increased before the normal operation is performed. Next, the controller 60 performs the startup forward rotation after the startup reverse rotation. In the startup forward rotation, the acceleration in the rotational speed of the motor 22 is reduced as compared to the startup reverse rotation so that the posture of the bushing 51 is maintained even if the forward rotation of the motor 22 is accelerated. Therefore, even if the forward rotation of the motor 22 is accelerated, the gap between the fixed scroll spiral wall 25*b* and the orbiting scroll spiral wall 26*b* is kept large. Then, when the rotational speed of the motor 22 reaches the predetermined rotational speed Nx by performing the startup forward rotation, the controller 60 performs the startup liquid discharge in which the orbiting scroll 26 makes orbital motion by driving the motor 22 at the predetermined rotational speed Nx to discharge liquefied refrigerant from the compression mechanism C1. According to this, since the orbiting scroll 26 makes orbital motion with the gap between the fixed scroll spiral wall 25*b* and the orbiting scroll spiral wall 26*b* kept large, liquid compression hardly occurs in the compression mechanism C1. As a result, liquefied refrigerant may be discharged from the compression mechanism C1 efficiently while loads applied to the fixed scroll spiral wall 25*b* and the orbiting scroll spiral wall 26*b* are suppressed.

(2) When the controller 60 performs the startup reverse rotation, the gap between the fixed scroll spiral wall 25*b* and the orbiting scroll spiral wall 26*b* is maximized. Therefore, the gap between the fixed scroll spiral wall 25*b* and the orbiting scroll spiral wall 26*b* is maintained at the maximum while the startup forward rotation is performed, and the orbiting scroll 26 makes orbital motion with the gap between the fixed scroll spiral wall 25*b* and the orbiting scroll spiral wall 26*b* maintained at the maximum while the startup liquid discharge is performed. This makes liquid compression in the compression mechanism C1 further less likely to occur. As a result, liquefied refrigerant may be discharged from the compression mechanism C1 while loads applied to the fixed scroll spiral wall 25*b* and the orbiting scroll spiral wall 26*b* are suppressed.

(3) When the controller 60 performs the startup post-liquid discharge forward rotation, the bushing 51 swings so that the fixed scroll spiral wall 25*b* and the orbiting scroll spiral wall 26*b* are placed in contact with each other. As a result, preparation for efficiently compressing refrigerant with the compression mechanism C1 in the normal operation when the operation is switched from the startup operation to the normal operation may be made smoothly.

(4) In the startup operation, the controller 60 reduces the acceleration in the rotational speed of the motor 22 as compared to in the startup post-liquid discharge forward rotation and rotates the motor 22 in the forward direction, after the startup post-liquid discharge forward rotation. As a result, the rotational speed of the motor 22 gradually approaches the command rotational speed N1 in the normal operation, and thus the motor 22 is driven precisely at the command rotational speed N1 in the normal operation when the operation is switched from the startup operation to the normal operation and the controller 60 performs the normal operation.

(5) According to the present embodiment, for example, it is not necessary to reduce the rotational speed of the motor 22 to an extremely low level to discharge liquefied refrigerant from the compression mechanism C1 for suppressing the loads applied to the fixed scroll spiral wall 25*b* and the orbiting scroll spiral wall 26*b* at the start of the scroll compressor 10. Therefore, the responsiveness of the scroll compressor 10 at the start may be improved.

Modification

The above-described present embodiment may be modified in various manners, as exemplified below. The above-described embodiment and the following modifications may be combined within the scope technically consistent with the present disclosure.

In the embodiment, the gap between the fixed scroll spiral wall 25*b* and the orbiting scroll spiral wall 26*b* does not have to be maximized in the startup reverse rotation. In short, in the startup reverse rotation, the controller 60 only has to rotate the motor 22 in reverse and cause the bushing 51 to swing in order to reduce the orbital radius of the orbiting scroll 26 so that the gap between the fixed scroll spiral wall 25*b* and the orbiting scroll spiral wall 26*b* is increased.

In the embodiment, the controller 60 may switch the operation to the normal operation once the rotational speed of the motor 22 reaches the command rotational speed N1 after performing the startup post-liquid discharge forward rotation without performing the startup low acceleration forward rotation in the startup operation.

Although the controller 60 drives the motor 22 by the sensorless control in the normal operation in the above embodiment, the control of the controller 60 is not limited to the sensorless control. The controller 60 may estimate the position of the rotor 24 using a sensor such as a resolver to drive the motor 22.

In the embodiment, the eccentric shaft 50 and the rotary shaft 15 do not have to be integrally formed, but the eccentric shaft 50 may be a separate part. In this case, the eccentric shaft 50 is attached to the distal end surface 15*e* of the rotary shaft 15.

In the embodiment, the balance weight 52 and the bushing 51 may be separate parts.

Although the scroll compressor 10 is used for the vehicle air-conditioning device in the present embodiment, the use of the scroll compressor 10 is not limited to the vehicle air conditioner. The scroll compressor 10 may be used in any desirable manner as long as the scroll compressor 10 is used for compressing refrigerant.

In the embodiment, the scroll compressor 10 does not have to compress refrigerant, but may compress fluids such as air.

What is claimed is:

1. A scroll compressor comprising:

a housing;

a rotary shaft rotatably supported by the housing;

a motor configured to rotate the rotary shaft;

a controller configured to control driving of the motor;

a compression mechanism driven by the motor and configured to compress refrigerant;

the compression mechanism including:

a fixed scroll that includes a fixed scroll base plate having a disk shape, and a fixed scroll spiral wall extending from the fixed scroll base plate; and an orbiting scroll that includes an orbiting scroll base plate having a disk shape and facing the fixed scroll base plate, and an orbiting scroll spiral wall extending from the orbiting scroll base plate and meshing with the fixed scroll spiral wall, the orbiting scroll and the fixed scroll cooperating to compress refrigerant with rotation of the rotary shaft;

an eccentric shaft extending from the rotary shaft at a position eccentric to an axial line of the rotary shaft, the eccentric shaft extending parallel to the axial line of the rotary shaft; and a bushing mounted on the eccentric shaft and swingable about the eccentric shaft, the bushing swinging about the eccentric shaft to change an orbital radius of the orbiting scroll, wherein the controller performs a startup operation to discharge liquefied refrigerant from the compression mechanism before performing a normal operation in which the motor is driven at a command rotational speed, and in the startup operation, the controller performs a startup reverse rotation in which the motor rotates in reverse and the bushing swings to reduce the orbital radius of the orbiting scroll so that a gap between the fixed scroll spiral wall and the orbiting scroll spiral wall is increased, the controller performs a startup forward rotation, after the startup reverse rotation, in which the motor rotates forward while an acceleration in a rotational speed of the motor is reduced as compared to the acceleration in the rotational speed in the startup reverse rotation to maintain a posture of the bushing, and the controller performs a startup liquid discharge, when the rotational speed of the motor reaches a predetermined rotational speed by performing the startup forward rotation, in which the motor is driven at the predetermined rotational speed to cause the orbiting scroll to make orbital motion so that the liquefied refrigerant is discharged from the compression mechanism.

2. The scroll compressor according to claim 1, wherein in the startup reverse rotation, the controller causes the bushing to swing so as to maximize the gap between the fixed scroll spiral wall and the orbiting scroll spiral wall.

3. The scroll compressor according to claim 1, wherein in the startup operation, the controller performs a startup post-liquid discharge forward rotation, after the motor is driven at the predetermined rotational speed, in which the bushing swings so that the fixed scroll spiral wall and the orbiting scroll spiral wall are placed in contact with each other.

4. The scroll compressor according to claim 3, wherein in the startup operation, after the startup post-liquid discharge forward rotation, the controller causes the motor to rotate forward while reducing the acceleration in the rotational speed of the motor as compared to the acceleration in the rotational speed in the startup post-liquid discharge forward rotation so that the rotational speed of the motor gradually approaches the command rotational speed in the normal operation.

* * * * *